United States Patent [19]

Lasher, III

[11] Patent Number: 5,025,574

[45] Date of Patent: Jun. 25, 1991

[54] REPLACEABLE SHOE HEEL ASSEMBLY

[76] Inventor: William W. Lasher, III, 2097 Dogwood Dr., Westfield, N.J. 07090

[21] Appl. No.: 425,916

[22] Filed: Oct. 24, 1989

[51] Int. Cl.[5] ..... A43B 21/36

[52] U.S. Cl. ..... 36/42; 36/36 R

[58] Field of Search ..... 36/42, 41, 36 R, 36 A, 36/36 B, 36 C

[56] References Cited

U.S. PATENT DOCUMENTS

| | | | |
|---|---|---|---|
| 97,681 | 12/1869 | Norburn . | |
| 221,592 | 11/1879 | Mitchell et al. . | |
| 235,290 | 12/1880 | Plunkett et al. . | |
| 638,043 | 11/1899 | Burwell . | |
| 879,011 | 2/1908 | Sedivi | 36/42 |
| 980,085 | 12/1910 | Fenton . | |
| 1,066,305 | 7/1913 | Mitchell . | |
| 1,142,662 | 6/1915 | Blaney . | |
| 1,156,769 | 10/1915 | Fortin . | |
| 1,596,805 | 8/1926 | Chakarian | 36/36 R |
| 1,631,710 | 6/1927 | Tranides . | |
| 1,966,293 | 7/1934 | Gillis | 36/36 R |
| 2,532,551 | 12/1950 | Malherbe . | |
| 2,556,842 | 6/1951 | Gilmour . | |
| 2,806,302 | 9/1957 | Sharpe . | |
| 3,192,652 | 7/1965 | Melchiorre . | |
| 3,193,949 | 7/1965 | Cortina . | |
| 4,214,384 | 7/1980 | Gonzales . | |
| 4,429,474 | 2/1984 | Metro . | |
| 4,610,100 | 9/1986 | Rhodes . | |
| 4,805,320 | 2/1989 | Goldenberg et al. . | |

*Primary Examiner*—Steven N. Meyers

*Attorney, Agent, or Firm*—Bacon & Thomas

[57] ABSTRACT

The replaceable tread portion of a shoe heel assembly is detachably secured to the fixed portion of the assembly through a dovetail connection defined by a retaining tongue extending rearwardly of a transverse block carried by the fixed portion and a corresponding recess formed in the tread portion for receiving the tongue, whereby the fixed and tread portions are secured together by a pair of screws. The fixed and tread portions are also provided with corresponding edge and surface areas disposable in engagement when the tread portion is fully secured to the fixed portion to further prevent movement and inadvertent detachment of the tread portion.

9 Claims, 2 Drawing Sheets

FIG. 3
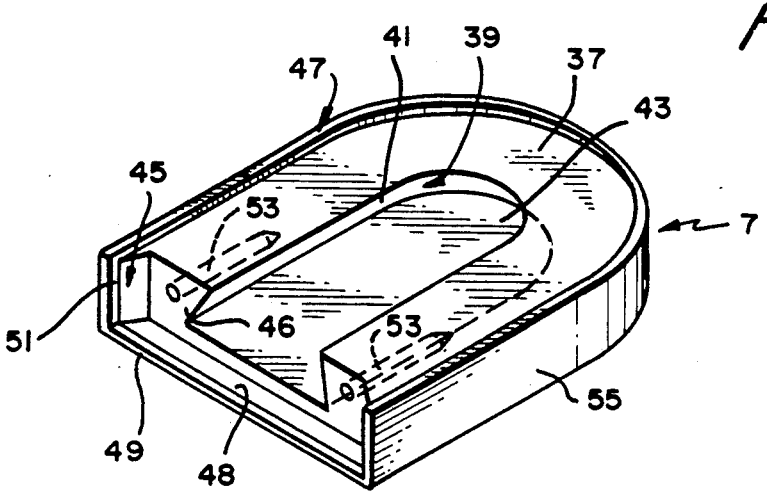
FIG. 4
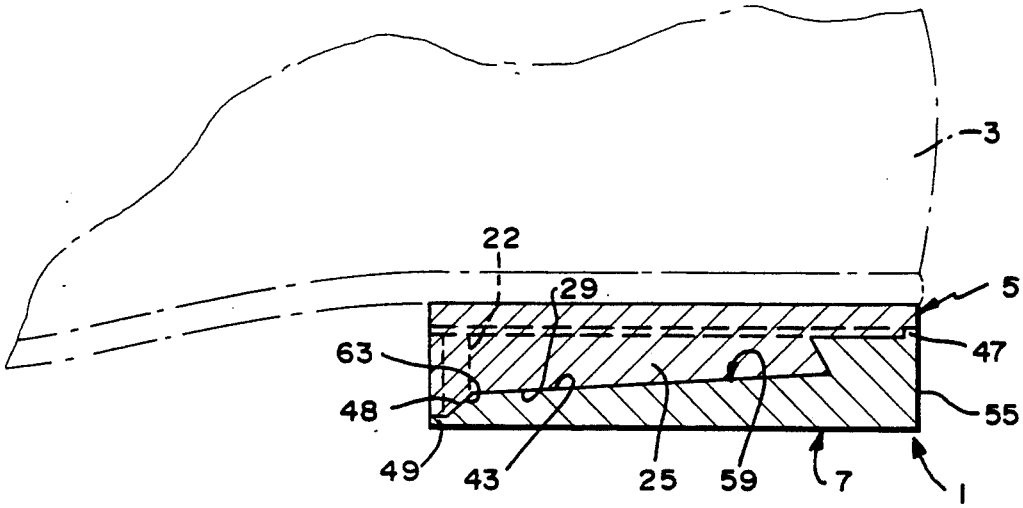
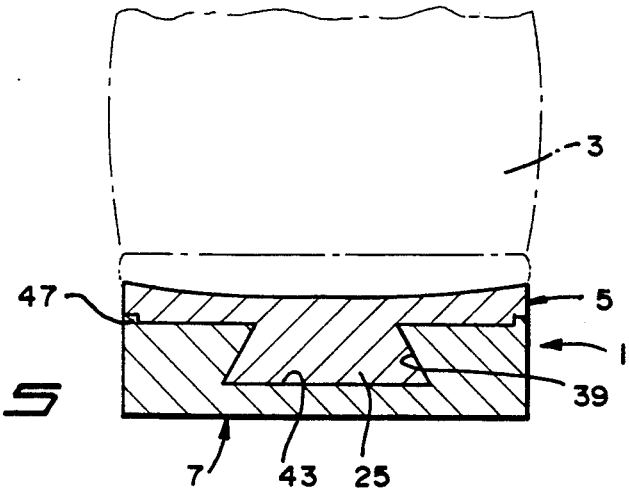
FIG. 5

REPLACEABLE SHOE HEEL ASSEMBLY

BACKGROUND OF THE INVENTION

1. Field of the Invention

The present invention generally involves the field of technology pertaining to shoe heel construction. More specifically, the invention relates to an improved shoe heel structure having a replaceable tread portion.

2. Description of the Prior Art

A conventional shoe heel is a permanent part of the shoe structure and is installed during the manufacturing process. The tread portion of the heel is prone to rapid wear and requires the time consuming and expensive services of a skilled cobbler for its replacement or repair.

The prior art indicates considerable effort expended in attempting to overcome this disadvantage by providing shoe heel structures whereby the worn heel portion may be easily repaired or replaced by the wearer and without the necessity of requiring the services of a skilled cobbler. This is generally realized by providing a heel structure that includes a fixed portion which is permanently attached to the sole of the shoe by appropriate fastening means, such as nailing or gluing, and a detachable tread portion which is detachably secured to the fixed portion and replaced when it becomes worn. The nature of the connection between the fixed and tread portions is critical in order to facilitate attachment and removal of the tread portion, and maintain the tread portion securely attached to the fixed portion against movement or inadvertent detachment during use of the shoe.

A common method for connecting the tread portion to the fixed portion involves configuring the mating sections of the two portions with corresponding interlocking structures, such as a dovetail and groove arrangement. It is also known to utilize mechanical fasteners, such as screws, pins or the like, by themselves and in combination with interlocking structures.

SUMMARY OF THE INVENTION

It is an object of the invention to provide an improved heel structure for a shoe.

It is another object of the invention to provide an improved shoe heel assembly having a replaceable tread portion.

It is a further object of the invention to provide an improved shoe heel assembly having a tread portion which may be easily attached to or removed from the shoe without requiring the services of a skilled cobbler.

It is yet another object of the invention to provide a replaceable shoe heel assembly comprised of a fixed portion and a tread portion having improved interlocking means for preventing relative movement and inadvertent detachment of the tread portion during normal use of the shoe.

These and other objects of the invention are realized by providing a shoe heel assembly which includes a fixed portion that is permanently attached to or is an integral part of the shoe, and a tread portion that is detachably engageable with the fixed portion through a cooperating interlock structure and mechanical fasteners. The interlock structure includes a transverse block extending across the front of the fixed portion, a dovetail-shaped retaining tongue extending rearwardly from and a structural continuation of the block, and a peripheral groove extending rearwardly from the sides and around the rear of the fixed portion. The tread portion is provided with a corresponding dovetail-shaped recess for receiving the retaining tongue and a corresponding upwardly extending flange for engagement within the groove. The front of the tread portion is provided with a truncated-shaped recess engageable by a correspondingly shaped rearward portion of the block and a pair of spaced apertures for receiving a pair of fasteners extending through the block to secure the tread portion to the fixed portion. The front of the tread portion is provided with a forwardly extending U-shaped flange which surrounds a forward peripheral edge of the block to prevent wear to the block.

Other objects, features and advantages of the invention shall become apparent from the following detailed description of a preferred embodiments thereof, when taken in conjunction with the drawings wherein like reference characters refer to corresponding parts in the several views.

BRIEF DESCRIPTION OF THE DRAWINGS

FIG. 3 is a perspective view of the tread portion.

FIG. 4 is a longitudinal cross sectional view showing the assembly attached to a shoe, the latter being partially shown in phantom lines.

FIG. 5 is a transverse cross sectional view showing the assembly attached to a shoe, the latter being partially shown in phantom lines.

DETAILED DESCRIPTION OF THE PREFERRED EMBODIMENTS

Figure 1:
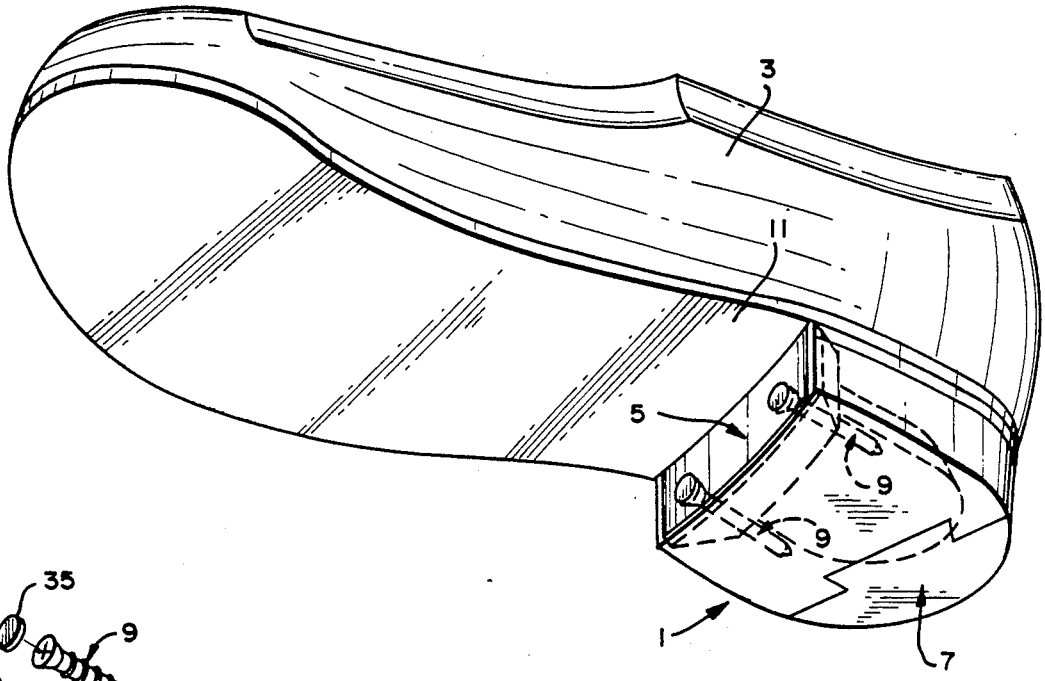
FIG. 1 is a perspective view of a shoe provided with a replaceable shoe heel assembly according to a preferred embodiment of the invention.

A replaceable shoe heel assembly 1 according to a preferred embodiment of the invention shall now be described with initial reference to FIGS. 1 and 2. As shown in FIG. 1, assembly 1 is depicted in its position of attachment to and forming the heel structure of a conventional shoe 3. Assembly 1 includes a fixed portion 5 and a replaceable heel portion 7 which is detachably secured to fixed portion 5 by a pair of mechanical fasteners 9 and an interlock connection between portions 5 and 7.

It is preferred that portions 5 and 7 be each integrally molded or formed from any appropriate material, such as rubber, plastic, a composite of rubber and plastic, or the like. Fixed portion 5 may also be either integrally formed with a sole 11 of shoe 3 as a single piece or separately formed and permanently attached to sole 11 by an appropriate fastening means, such as nailing, gluing, stitching or the like. In either case, fixed portion 5 forms a permanent part of shoe 3.

Figure 2:
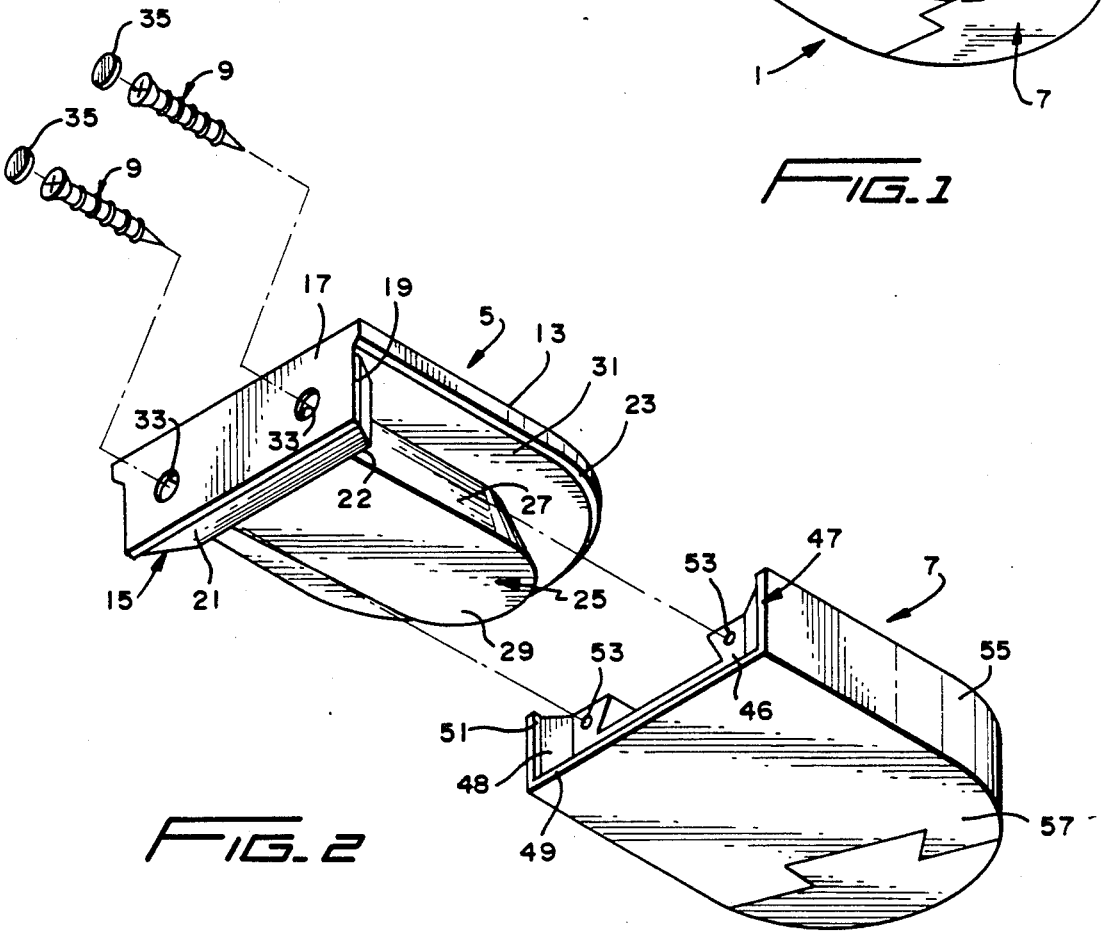
FIG. 2 is an exploded perspective view of the top portion, tread portion and mechanical fasteners forming the assembly.

As seen in FIG. 2., fixed portion 5 and tread portion 7 are each correspondingly configured to permit an interlocking engagement therebetween and collectively define the overall configuration of a heel structure. Fixed portion 5 includes a substantially planar upper surface 13 for attachment to sole 11. Fixed portion 5 is provided with a mounting block 15 which extends transversely across substantially the entire front of portion 5 and includes a front planar face 17 which is disposed at a right angle to upper surface 13. Block 15 has a peripheral edge 19 of substantially U-shaped configuration extending inwardly from around the side and bottom edges of face 17. Block 15 also includes a substantially truncated-shaped section 21 having three sides converging rearwardly from the three sides of edge 19 and terminating in a rear face 22.

The rearward periphery of top portion 5 is undercut to form a U-shaped groove 23 which extends rearwardly along the sides and around the rear of portion 5, and terminating forwardly on opposite sides of edge 19. Groove 23 has a substantially L-shaped transverse cross sectional configuration. The undercut periphery of portion 5 also defines a retaining tongue 25 which is undercut and extends rearwardly from rear face 22 of truncated section 21, and includes an inwardly converging side wall 27 and a rearwardly inclined lower planar face 29 which collectively impart a dovetail configuration to tongue 25. Tongue 25 therefore extends rearwardly from and is a structural continuation of block 15. Sidewall 27 terminates inwardly at a U-shaped lower surface 31 which extends longitudinally between and around both sidewall 27 and groove 23, and terminates on opposite sides of truncated section 21. Block 21 is also provided with a pair of spaced apertures 33 which extend completely therethrough on opposite sides of tongue 25 for receiving fasteners 9 therethrough. Each fastener 9 is depicted as a threaded screw which may be formed of plastic or metal, but it is understood that other appropriate mechanical fasteners may also be utilized to advantage. A pair of caps 35 may be disposed within apertures 33 after the insertion of fasteners 9 to conceal the countersunk heads thereof. Caps 35 are preferably formed of the same material forming top portion 5 and may be secured in place by any appropriate means, such as gluing or the like.

With further reference to FIG. 3, it can be seen that tread portion 7 includes a substantially U-shaped upper surface 37, the central portion of which is undercut to form a dovetail-shaped recess 39 corresponding in configuration to the dovetail configuration of retaining tongue 25 for receiving same. Recess 39 includes an outwardly diverging sidewall 41 for engaging sidewall 27 of tongue 25 and a rearwardly inclined bottom wall 43 corresponding in size and configuration to face 29 of tongue 25 for engaging same. Surface 37, sidewall 41 and bottom wall 43 all collectively terminate at the front of portion 7 to partially define a truncated-shaped recess 45 corresponding in configuration to that of truncated section 21 of portion 5 for receiving same. Recess 45 includes a front face 46 corresponding in configuration to rear face 22 of section 21 for engagement thereby, and a U-shaped converging wall section 48 for engagement by the three sides of section 21. An upwardly directed flange 47 extends around the periphery of surface 37 and continues around the front of wall section 48 to form a substantially U-shaped portion 49 thereat. A U-shaped peripheral surface 51 extends inwardly from portion 49, with surface 51 being configured and sized for surrounding and engaging peripheral edge 19 of block 15. Portion 7 is also provided with a pair of longitudinal passageways 53 extending inwardly from opposite sides of front face 46 and being coaxially aligned with apertures 33 for receiving fasteners 9 therein. Portion 7 also includes a U-shaped exterior sidewall 55 and a substantially planar bottom surface 57.

The manner in which tread portion 7 is attached to fixed portion 5 shall now be described with reference to FIGS. 4 and 5. As apparent from the foregoing description, and particularly the exploded view shown in FIG. 2, tread portion 7 is assembled onto fixed portion 5 by disposing the front of portion 7 adjacent the rear of portion 5 and sliding portion 7 longitudinally towards the front of portion 5. This serves to engage retaining tongue 25 within recess 39 and form a dovetail connection therebetween. Truncated section 21 is also engaged within truncated recess 45, flange 47 within groove 23, and surface 51 around edge 19. This produces an assembled interlock between portions 5 and 7, as shown in FIGS. 4 and 5. When this assembly is established, fasteners 9 are engaged through apertures 33 and passageways 53 until the heads thereof are recessed below surface 17 of block 15. Thereafter, caps 35 are secured within apertures 33 so that the exterior surfaces of caps 35 are coplanar with surface 17, thereby effectively concealing fasteners 9 from view.

As also depicted in FIGS. 4 and 5, the corresponding inclined configurations of face 29 and bottom wall 43 collectively define an interface 59 which is also inclined from the front of assembly 1 towards the rear thereof. Moreover, as particularly seen in FIG. 4, U-shaped portion 49 of flange 47 completely surrounds peripheral edge 19, thereby preventing wear to block 15 and confining wear solely to replaceable tread portion 7. It is further possible to provide concealed areas of fixed portion 5 disposed adjacent areas of tread portion 7 subjected to increased wear with color coding or indication in order to visually alert the wearer when tread portion 7 is in need of replacement.

Through this arrangement, the dovetail engagement between tongue 25 and recess 39 prevents any relative movement of tread portion 7 in either sideward or downward directions The engagement of flange 47 in groove 23 prevents both sideward and forward movement of portion 7. The presence of block 15 and the engagement of truncated section 21 in truncated recess 45 prevents forward movement of tread portion 7, and the presence of fasteners 9 prevent the rearward movement of portion 7. This arrangement facilitates the wearer in removing and replacing tread portion 7 in a simple manner, and the interlock connection between portions 5 and 7, and the presence of fasteners 9, assure the secure attachment of portion 7 to portion 5 under all normal conditions of use.

Though the invention has been described herein in accordance with examples thereof, such examples shall be construed as only preferred embodiments of the invention and that various changes in size, shape, composition and arrangement of parts may be resorted to by those skilled in the art and within the spirit and scope of the subjoined claims.

What is claimed is:

1. A replaceable shoe heel assembly comprising:

a) a top portion for permanent attachment to a shoe and a tread portion detachably engageable with the top portion;

b) the top portion including a front and a rear, a mounting block extending transversely across the front defining a rear face, and a dovetail-shaped retaining tongue extending from the mounting block towards the rear, the width of the retaining tongue being less than that of the mounting block;

c) the tread portion including a front and a rear, a dovetail-shaped recess extending longitudinally from the front towards the rear for engagement by the retaining tongue, and a transverse recess extending transversely across the front for engagement by the block the recess having a front face; and d) means for securing the top and tread portions together with the tongue is engaged within the dovetail recess and the mounting block is engaged within the transverse recess such that the rear face of the mounting block is adjacent to the front face of the recess.

2. The shoe heel assembly of claim 1 wherein the means for securing the top and tread portions together include:

a) a plurality of apertures extending through the block from the front to the rear thereof;

b) a plurality of corresponding passageways extending through the tread portion from the front face of the transverse recess towards the rear thereof; and c) a plurality of mechanical fasteners engageable through the apertures and passageways.

3. The shoe heel assembly of claim 2 further including a plurality of caps disposable within the apertures for concealing the fasteners.

4. The shoe heel assembly of claim 1 wherein:

a) the mounting block includes a truncated section defined by three sides converging towards the rear face of the mounting block; and b) the transverse recess is of a corresponding truncated configuration defined by three sides converging rearwardly toward the front face of the recess such that the three converging sides of the truncated section are disposable against the three converging sides of the transverse recess when the mounting block in engaged therein.

5. The shoe heel assembly of claim 1 wherein:

a) the top portion defines a substantially U-shaped groove extending along a pair of sides and the rear thereof; and b) the tread portion has a corresponding U-shaped flange extending around a pair of sides and the rear thereof for engagement within the substantially U-shaped groove when the top and the thread portions are detachably engaged.

6. The shoe heel assembly of claim 1 wherein:

a) the mounting block includes a substantially U-shaped edge; and, b) the tread portion includes a corresponding U-shaped flange extending from the front thereof for surrounding the U-shaped edge and preventing wear thereto.

7. The shoe heel assembly of claim 1 wherein:

a) the retaining tongue includes a bottom face and the dovetail recess includes a bottom wall engageable by the bottom face; and b) the bottom face and bottom wall defining an interface therebetween when engaged with each other, wherein the interface is inclined from the front to the rear of the top and thread portions.

8. The shoe heel assembly of claim 1 wherein the retaining tongue is integrally molded with the mounting block and forms a continuation thereof towards the rear of the top portion.

9. The shoe heel assembly of claim 1 wherein the top and thread portions are each integrally molded.

* * * * *